US005360695A

United States Patent [19]

Texter

[11] Patent Number: 5,360,695

[45] Date of Patent: Nov. 1, 1994

[54] AQUEOUS DEVELOPABLE DYE DIFFUSION TRANSFER ELEMENTS CONTAINING SOLID PARTICLE THERMAL SOLVENT DISPERSIONS

[75] Inventor: John Texter, Rochester, N.Y.

[73] Assignee: Eastman Kodak Company, Rochester, N.Y.

[21] Appl. No.: 8,914

[22] Filed: Jan. 26, 1993

[51] Int. Cl.[5] ..... G03C 5/54

[52] U.S. Cl. ..... 430/203; 430/218; 430/546; 430/617; 430/619; 430/955

[58] Field of Search ..... 430/203, 351, 617, 619, 430/955, 218, 546

[56] References Cited

U.S. PATENT DOCUMENTS

| | | | |
|---|---|---|---|
| 3,667,959 | 6/1972 | Bojara et al. | 430/619 |
| 3,676,147 | 7/1972 | Boyer et al. . | |
| 4,006,025 | 2/1977 | Swank et al. . | |
| 4,474,872 | 10/1984 | Onishi et al. . | |
| 4,555,470 | 11/1985 | Sakaguchi et al. | 430/203 |
| 4,927,744 | 5/1990 | Henzel et al. . | |
| 4,948,718 | 8/1990 | Factor et al. . | |
| 4,952,479 | 8/1990 | Aono et al. | 430/203 |
| 4,983,502 | 1/1991 | Ohbayashi et al. | 430/203 |

FOREIGN PATENT DOCUMENTS

| | | |
|---|---|---|
| 1105761 | 7/1981 | Canada . |
| 0545433A1 | 6/1993 | European Pat. Off. . |
| 62-136645 | 6/1987 | Japan . |
| 73751 | 3/1992 | Japan . |
| 1570362 | 7/1980 | United Kingdom . |

*Primary Examiner*—Richard L. Schilling
*Attorney, Agent, or Firm*—Paul A. Leipold

[57] ABSTRACT

An aqueous developable chromogenic photographic dye-diffusion transfer element of two or more layers comprising a support, radiation sensitive silver halide, a dye-forming compound wherein said compound forms a heat transferable dye upon reaction of said compound with the oxidation product of a primary amine developing agent, a hydrophilic binder, and a solid particle thermal solvent dispersion, wherein said thermal solvent is a water-immiscible phenol derivative, has a melting point of between 50° C. and about 200° C., and is incorporated at 5 to 200% by weight of said hydrophilic binder, and where said thermal solvent dispersion contains a dispersing aid, is disclosed.

40 Claims, No Drawings

AQUEOUS DEVELOPABLE DYE DIFFUSION TRANSFER ELEMENTS CONTAINING SOLID PARTICLE THERMAL SOLVENT DISPERSIONS

RELATED APPLICATIONS

This application is related to the following copending and commonly assigned applications: *Heat Image Separation Systems* of Willis and Texter, filed Dec. 6, 1991 as U.S. application Ser. No. 07/804,877; *Thermal Solvents for Dye Diffusion in Image Separation Systems* of Bailey et al., filed Dec. 6, 1991 as U.S. application Ser. No. 07/804,868; *Polymeric Couplers for Heat Image Separation Systems* of Texter et al., filed Aug. 10, 1992 as U.S. application Ser. No. 07/927,691; and *Dye-Releasing Couplers for Heat Image Separation Systems* of Texter et al., filed Dec. 21, 1992 as U.S. application Ser. No. 07/993,580.

FIELD OF THE INVENTION

This invention relates to photographic systems and processes for forming a dye image in a light sensitive silver halide emulsion layer, and subsequently separating the dye image from the emulsion layer. More particularly, this invention relates to said processes comprising aqueous alkaline development for forming dye images in silver halide emulsion layers and to dry thermal dye-diffusion image-separation systems.

BACKGROUND OF THE INVENTION

Solid Particle Dispersion Technology

Langen et at., in U.K. Pat. No. 1,570,362 disclose the use of solid particle milling methods such as sand milling, bead milling, dyno milling, and related media, ball, and roller milling methods for the production of solid particle dispersions of photographic additives such as couplers, UV-absorbers, UV stabilizers, white toners, stabilizers, and sensitizing dyes.

Henzel and Zengerle, in U.S. Pat. No. 4,927,744, disclose photographic elements comprising solid particle dispersions of oxidized developer scavengers. Said dispersions are prepared by precipitation and by milling techniques such as ball-milling.

Boyer and Caridi, in U.S. Pat. No. 3,676,147, disclose a method of ball-milling sensitizing dyes in organic liquids as a means of spectrally sensitizing silver halide emulsions. Langen et al., in Canadian Patent No. 1,105,761, disclose the use of solid particle milling methods and processes for the introduction of sensitizing dyes and stabilizers in aqueous silver salt emulsions.

Swank and Waack, in U.S. Pat. No. 4,006,025, disclose a process for dispersing sensitizing dyes, wherein said process comprises the steps of mixing the dye particles with water to form a slurry and then milling said slurry at an elevated temperature in the presence of a surfactant to form finely divided particles. Onishi et al., in U.S. Pat. No. 4,474,872, disclose a mechanical grinding method for dispersing certain sensitizing dyes in water without the aid of a dispersing agent or wetting agent. This method relies on pH control in the range of 6–9 and temperature control in the range of 60°–80° C.

Factor and Diehl, in U.S. Pat. No. 4,948,718, disclose solid particle dispersions of dyes for use as filter dyes in photographic elements. They disclose that such dyes can be dispersed as solid particle dispersions by precipitating or reprecipitating (solvent or pH shifting), by ball-milling, by sand-milling, or by colloid-milling in the presence of a dispersing agent.

Iwagaki et al., in unexamined Japanese Kokai No. Sho 62[1987]-136645, disclose solid particle dispersions of heat solvent, wherein said heat solvent has a melting point of 130° C. or greater. These heat solvent dispersions are incorporated in a thermally developed photosensitive material incorporating silver halide, a reducing agent, and a binder on a support, wherein said material obtains improved storage stability. Komamura and Nimura, in unexamined Japanese Kokai No. Hei 4[1992]-73751, disclose a ball-milled dispersion of the following compound (TS-i):

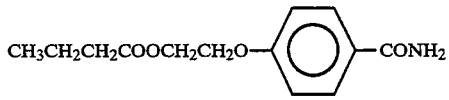

(TS-i)

A novel method of imaging, whereby conventional aqueous development processes are utilized in combination with substantially dry thermally activated diffusion transfer of image dyes to a polymeric receiver has been described by Willis and Texter in commonly assigned U.S. application Ser. No. 07/804,877, filed Dec. 6, 1991, *Heat Image Separation Systems*, by Bailey et al. in commonly assigned U.S. application Ser. No. 07/804,868, filed Dec. 6, 1991, *Thermal Solvents for Dye Diffusion in Image Separation Systems*, by Texter et al. in commonly assigned U.S. application Ser. No. 07/927,691, filed Aug. 10, 1992, *Polymeric Couplers for Heat Image Separation Systems*, and by Texter et al. in commonly assigned U.S. application Ser. No. 07/993,580, filed Dec. 21, 1992, *Dye-Releasing Couplers for Heat Image Separation Systems.*

The morphology of a photographic element for such systems generally consists of a (1) dimensionally stable support of transparent or reflection material, (2) a receiver layer to which the diffusible dyes migrate under thermal activation, (3) optionally a stripping layer, (4) one or more diffusible-dye forming layers in which the light image is captured and amplified during conventional aqueous color development, and (5) a protective overcoat. Latent image in the diffusible-dye forming layers is captured using well known silver halide technology and these images are amplified in conventional aqueous color development. After aqueous development the element is subjected to a stop/wash bath, dried, and then heated to drive the diffusible-dye image to the receiver. Thereafter, the support and receiver layer are separated from the diffusible-dye forming layers by a stripping method, such as that disclosed by Texter et al. in U.S. Pat. No. 5,164,280, *Mechanico-chemical Layer Stripping in Image Separation Systems.* The separated diffusible-dye forming layers may subsequently be used as a source of recoverable silver and other fine chemicals.

Komamura and Nimura, in unexamined Japanese Kokai No. Hei 4[1992]-73751, disclose a method for forming images, where said method uses a photographic material having a support and a photosensitive silver halide layer containing dye-producing material, binder, and a thermal solvent, image exposure, liquid development, lamination of said developed material to a receiver, and heating of said laminate.

Thermal Solvents

The term thermal solvent in the description and claims of the present invention refers to any organic compound that facilitates or improves the nonaqueous thermal diffusion of a heat transferable dye through a hydrophilic binder. This meaning is distinguished from other usages of this term and of related terms, such as heat solvent, used in heat developable photographic elements. These alterative usages relate to organic compounds that facilitate the nonaqueous heat development of silver halide and other silver salts, compounds that serve as solvents for incorporated developing agents, and compounds that have high dielectric constant and accelerate physical development of silver salts. These alternative usages are exemplified in the heat developable photographic elements disclosed by Henn and Miller (U.S. Pat. No. 3,347,675), Yudelson (U.S. Pat. No. 3,438,776), Bojara and de Mauriac (U.S. Pat. No. 3,667,959), La Rossa (U.S. Pat. No. 4,168,980), Baxendale and Wood (in laid open for inspection U.S. application Ser. No. 865,478, abstract published Oct. 21, 1969), Masukawa and Koshizuka (U.S. Pat. No. 4,584,267), Komamura et al. (U.S. Pat. No. 4,770,981), Komamura (U.S. Pat. No. 4,948,698), Aono and Nakamura (U.S. Pat. No. 4,952,479), Ohbayashi et al. (U.S. Pat. No. 4,983,502), Iwagaki et al. (Japanese Kokai No. Sho 62[1987]-136645), and Komamura and Nimura (Japanese Kokai No. Hei 4[1992]-73751).

Bailey et al., in commonly assigned U.S. application Ser. No. 07/804,868, filed Dec. 6, 1991, showed that thermal solvents of phenol derivatives according to the structure

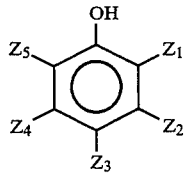

wherein (a) $Z_1$, $Z_2$, $Z_3$, $Z_4$, and $Z_5$ are substituents, the Hammet sigma parameters of $Z_2$, $Z_3$, and $Z_4$ sum to give a total, $\Sigma$, of at least $-0.28$ and less than 1.53;

(b) the calculated logP for I is greater than 3 and less than 10; and where Hammet sigma parameters and the calculated logP parameter are described below, are particularly effective in promoting thermal dye diffusion in heat image separation systems. This effectiveness was demonstrated to be particularly applicable for facilitating thermal dye diffusion through dry gelatin. Bailey et al. also demonstrated in extensive comparative experimentation that the preferred benzamide compounds of Iwagaki et al. (Japanese Kokai No. Sho 62[1987]-136645) and of Komamura and Nimura (Japanese Kokai No. Hei 4[1992]-73751) were particularly ineffective as thermal solvents in heat image separation systems in comparison to the preferred phenol compounds of the elements and processes of the invention claims of Bailey et al. In particular, the example compound (TS-ii) of Komamura (U.S. Pat. No. 4,948,698), which differs by one methylene group from compound TS-i of (TS-ii)

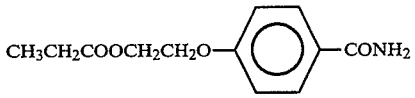

Komamura and Nimura (Japanese Kokai No. Hei 4[1992]-73751 ) was shown to have very poor activity for promoting thermal dye diffusion transfer of heat transferable dyes through dry gelatin.

Materials can be described by a variety of extrathermodynamic properties and parameters to relate their activity, according to some performance measure, to their structure. One of the best known of such classifications is the Hammett substituent constant, as described by L. P. Hammett in *Physical Organic Chemistry* (McGraw-Hill Book Company, New York, 1940) and in other organic text books, monographs, and review articles. These parameters, which characterize the ability of meta and para ring-substituents to affect the electronic nature of a reaction site, were originally quantified by their effect on the $pK_a$ of benzoic acid. Subsequent work has extended and refined the original concept and data, but for the purposes of prediction and correlation, standard sets of such constants, $s_{meta}$ and $s_{para}$, are widely available in the chemical literature, as for example in C. Hansch et al., *J. Med. Chem.*, 17, 1207 (1973).

Another parameter of significant utility relates to the variation in the partition coefficient of a molecule between octanol and water. This is the so-called logP parameter, for the logarithm of the partition coefficient. The corresponding substituent or fragment parameter is the Pi parameter. These parameters are described by C. Hansch and A. Leo in *Substituent Constants for Correlation Analysis in Chemistry and Biology* (John Wiley & Sons, New York, 1969). Calculated logP (often termed cLogP) values are calculated by fragment additivity treatments with the aid of tables of substituent Pi values, or by use of expert programs that calculate octanol/water partition coefficients based on more sophisticated treatments of measured fragment values. An example of the latter is the widely used computer program, *MedChem Software* (Release 3.54, August 1991, Medicinal Chemistry Project, Pomona College, Claremont, Calif.).

The use of these parameters allows one to make quantitative predictions of the performance of a given molecule, and in the present invention, of a given thermal solvent candidate. The Hammett parameters are routinely summed, to give a net electronic effect $\Sigma$, where $\Sigma$ is the sum of the respective substituent $\sigma_{meta}$ and $\sigma_{para}$ values. Substituent and fragment parameters are readily available, so that logP and $\Sigma$ estimates may be easily made for any prospective molecule of interest.

PROBLEM TO BE SOLVED BY THE INVENTION

It has previously been unrecognized that the melt mixing prior to coating of spectrally sensitized silver halide dispersions and thermal solvent dispersions can lead to desensitization and large speed losses in the photographic elements thereafter coated. This problem is particularly evident when the thermal solvent of said thermal solvent dispersion has a melting point lower than the melt hold temperature of said melt mixing or coating process. This problem is especially prevalent when said thermal solvent is a liquid at room temperature.

It has also previously been unrecognized that the melt mixing prior to and during coating of cyan coupler dispersions and thermal solvent dispersions can lead to significant inhibition of cyan coupling activity. This problem is particularly evident when the thermal solvent of said thermal solvent dispersion has a melting point lower than the melt hold temperature of said melt mixing or coating process, and is especially prevalent when said thermal solvent is a liquid at room temperature.

The crystallization of thermal solvents in amorphous thermal solvent dispersions during storage, during the preparation of photographic elements, and during the storage of photographic elements is a previously unrecognized problem in the preparation and storage of photographic elements incorporating such dispersions. Such crystallization usually leads to crystallites in excess of 10 μm in largest dimension. Said crystallites cause unwanted scattering of light in photographic elements and cause gelation of melts and clogging of filters in the coating of photographic elements.

These and other problems may be overcome by the practice of our invention.

SUMMARY OF THE INVENTION

An object of this invention is to provide thermal solvent dispersions with greatly reduced propensity to ripen into thermal solvent crystallites that clog filters and cause unwanted light scattering effects in coated photographic elements.

These and other objects of the invention are generally accomplished by providing an aqueous developable chromogenic photographic dye-diffusion transfer element of two or more layers comprising a support, radiation sensitive silver halide, a dye-forming compound wherein said compound forms a heat transferable dye upon reaction of said compound with the oxidation product of a primary amine developing agent, a hydrophilic binder, and a solid particle thermal solvent dispersion, wherein said thermal solvent is a water-immiscible phenol derivative, has a melting point of between 50° C. and about 200° C., and is incorporated at 5 to 200% by weight of said hydrophilic binder, and where said thermal solvent dispersion contains a dispersing aid.

ADVANTAGEOUS EFFECT OF THE INVENTION

The solid particle thermal solvent dispersions of the present invention greatly reduce the propensity for thermal solvent induced desensitization of silver halide during melt hold and coating processes. This reduction advantageously provides greater robustness in the variability of emulsion sensitivity and color quality in color photographic elements incorporating said dispersions. The solid particle thermal solvent dispersions of the present invention also greatly reduce and largely eliminate cyan coupling activity inhibition, in comparison to thermal solvents dispersions not of the present invention. This reduction of coupling activity inhibition advantageously provides greater cyan dye densities with lower quantities of developed silver, and also provides improved cyan dye hues. In addition, thermal solvent ripening into large crystallites greater than about 10 μm in average dimension that clog filters, form interconnected gel structures and networks, and cause unwanted light scattering effects in coated photographic elements is greatly reduced. Polluting effluent from bleaching and fixing processing steps is advantageously eliminated in the processes of the present invention; the need for such steps is advantageously eliminated by the dye diffusion process that separates the dye image from the silver image.

DETAILED DESCRIPTION OF THE INVENTION

The term thermal solvent refers to any organic compound that facilitates or improves the nonaqueous thermal diffusion of a heat transferable dye through a hydrophilic binder. This term is distinguished from related terms, such as heat solvent, used in heat developable photographic elements which relate to organic compounds that facilitate the nonaqueous heat development of silver halide and other silver salts.

The term heat transferable dye refers to any dye that will diffuse through a hydrophilic binder when heated without the need for said binder to be in a water swollen or wetted state. Such diffusion would occur, for example, through gelatin that contains less than 20% by weight water. Such dyes, furthermore, do not contain solubilizing groups meant to immobilize dyes in relatively dry gelatin, as taught by Masukawa et al. in U.S. Pat. No. 4,584,267.

The term solid particle dispersion means a dispersion of particles wherein the physical state of particulate material is solid rather than liquid or gaseous. This solid state may be an amorphous state or a crystalline state. The expression microcrystalline particles means that said particles are in a crystalline physical state, and further that said particles are smaller than 5 μm in average dimension.

The term "nondiffusing" used herein as applied to the couplers and diffusible-dye forming compounds has the meaning commonly applied to the term in color photography and denotes materials, which for all practical purposes, do not migrate or wander through water swollen organic colloid layers, such as gelatin, comprising the sensitive elements of the invention at temperatures of 40° C. and lower. The term "diffusible" as applied to dyes formed from these "nondiffusing" couplers and compounds in the processes has somewhat of a converse meaning and denotes materials having the property of diffusing effectively through relatively dry colloid layers of the sensitive elements in the presence of the "nondiffusing" materials from which they are derived. The terms "dye-receiving" and "image-receiving" are used synonomously herein. In the following discussion of suitable materials for use in the elements and methods of the present invention, reference is made to *Research Disclosure*. December 1989, Item 308119, pages 993–1015, published by Kenneth Mason Publications, Ltd., Emsworth, Hampshire PO 10 7DQ, United Kingdom, the disclosure of which is incorporated herein in its entirety by reference. This publication is identified hereafter as "Research Disclosure".

The term aqueous developable refers to a light sensitive photographic element that can be effectively developed by aqueous color developer solution at normal processing temperatures of 20°–45° C. Such elements are routinely coated with hydrophilic binders, such as gelatin, where said binders swell upon contact with aqueous solutions.

Element Layer Structure

A suitable integral layer structure for elements of the present invention generally consists of a (1) dimensionally stable support of transparent or reflection material, (2) a receiver layer to which the diffusible dyes migrate under thermal activation, (3) optionally a stripping layer, (4) one or more imaging layer(s) (comprising silver halide and diffusible-dye releasing couplers) in which the light image is captured and amplified during conventional aqueous color development, and (5) a protective overcoat. Separate stripping layers in such structures may be omitted. The imaging layer(s) and overcoat layer comprise a "donor" element. The support and dye-receiving layer comprises a "receiving" element.

Another suitable structure for elements of the present invention is a non-integral structure, comprising separate donor and receiver elements. The donor element comprises a support, one or more imaging layers, and optionally a protective overcoat layer. Such a donor element, subsequent to aqueous development and drying, is laminated to a suitable receiver element and heated to effect image dye transfer. Suitable receiver elements generally comprise a support and a dye-receiving layer or layers.

Support

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements can be coated on a variety of supports such as described in Research Disclosure, Section XVII and the references described therein. Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like. Preferred paper-base supports also comprise auxiliary pigments such as titania (anitase, rhutile) to improve the reflectivity to visible light of said support. Suitable supports of the present invention can contain optical brighteners (see Research Disclosure, Section V). Suitable supports also include transparent film supports. In the integral layer structure and in the receiver element described above, said support and receiver support may each independently be a transparent film support or an opaque reflection support, depending on the desired application and use of the resulting print material (receiver element). In the donor element described, said donor support preferably is an opaque reflection support. Said donor support may be a transparent film support.

Dye-Receiving Layers

The dye-receiving layer or layers to which the formed dye image is transferred according to the present invention may be coated on the photographic element between the emulsion layer and support, or may be in a separate dye-receiving element which is brought into contact with the photographic element during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly(caprolactone)s and mixtures thereof. The dye receiving layer may be present in any amount which is effective for the intended purpose. In general, good results have been obtained with amounts of from about 1 to about 10 $g/m^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylene glycol, 2,2-bis(4-oxyphenyl)-propane, bis(4-oxyphenyl)methane, 1,1-bis(4-oxyphenyl)ethane, 1,1-bis(oxyphenyl)butane, 1,1-bisphenol-A polycarbonate having a number average molecular weight of at least about 25,000 is used. Examples of preferred polycarbonates include General Electric LEXAN Polycarbonate Resin and Bayer AG MACROLON 5700. Further, a thermal dye transfer overcoat polymer as described in U.S. Pat. No. 4,775,657 may also be used.

Stripping Layers

Stripping layers are included in preferred embodiments to facilitate the mechanical separation of receiver layers and mordant layers from donor layers and diffusible dye forming layers. Stripping layers are usually coated between a dye receiving layer and one or more diffusible dye-forming layers. Stripping layers may be formulated essentially with any material that is easily coatable, that will maintain dimensional inegrity for a sufficient length of time so that a suitable image may be transferred by dye diffusion there through with sufficiently adequate density and sharpness, and that will facilitate the separation of donor and receiver components of the photographic element under suitable stripping conditions. Said dimensional stability must be maintained during storage and during the development and dye forming process. In preferred embodiments this dimensional stability is maintained during all wet or aqueous processing steps and during subsequent drying. Various stripping polymers and stripping agents may be used alone and in combination in order to achieve the desired strippability in particular processes with particular photographic elements. The desired strippability in a given process is that which results in clean separation between the image receiving layer(s) and the emulsion and diffusible dye forming layers adhering to the image receiving layer. Good results have in general been obtained with stripping agents coated at level of 3 $mg/m^2$ to about 500 $mg/m^2$. The particular amount to be employed will vary, of course, depending on the particular stripping agent employed and the particular photographic element used, and the particular process employed.

Perfluoronated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

$$CF_3(CF_2)_n-SO_2-\overset{\overset{R_1}{|}}{N}-CH_2R_2$$

wherein $R_1$ is an alkyl or substituted alkyl group having from 1 to about 6 carbon atoms or an aryl or substituted aryl group having from about 6 to about 10 carbon atoms; $R_2$ is $$-\overset{\overset{O}{\|}}{C}-O-(CH_2CH_2O)_x-R_3,$$

$$-\overset{\overset{O}{\|}}{C}-O-(CH_2)_y-R_3,$$

or $$-CH_2-O-(CH_2CH_2O)_z-R_3;$$

$R_3$ is H or $R_1$; n is an integer of from about 4 to about 19; x and y each represents an integer from about 2 to about 50, and z each represents an integer of from 1 to about 50. In another preferred embodiment, $R_1$ is ethyl, $R_2$ is $$-\overset{\overset{O}{\|}}{C}-O-(CH_2CH_2O)_x-H,$$

n is about 8, and x is about 25 to 50. In another preferred embodiment, $R_1$ is ethyl, $R_2$ is $$-\overset{\overset{O}{\|}}{C}-O-(CH_2)_y-H,$$

n is about 8, and y is about 25 to 50. In another preferred embodiment, $R_1$ is ethyl, $R_2$ is $-CH_2O(CH_2CH_2O)_zH$, n is 8 and z is 1 to about 30.

If the process of this invention is used to produce a transparency element for use in high magnification projection, it is desirable to maintain sharpness and to minimize the thickness of the diffusion path. This minimization is achieved in part by using a stripping layer that does not swell appreciably and which is as thin as possible. These requirements are met by the perfluoronated stripping agents herein described. These agents provide clean stripping and do not materially alter the surface properties at the stripping interface. These perfluoronated stripping agents also provide for a stripping layer with weak dry adhesion. A strong dry adhesion makes separation of substantially dry elements difficult.

Preferred stripping agents useful in the process of this invention include the compounds:

SA1

$$C_8F_{17}SO_2-\overset{\overset{CH_2CH_3}{|}}{N}-CH_2-\overset{\overset{O}{\|}}{C}-O-(CH_2CH_2O)_{40}-H$$

(Fluorad ® FC-431 [3M Company])

SA2

$$C_8F_{17}SO_2-\overset{\overset{CH_2CH_3}{|}}{N}-CH_2-\overset{\overset{O}{\|}}{C}-(CH_2)_{40}-H$$

(Fluorad ® FC-432 [3M Company])

-continued

SA3

$$C_8F_{17}SO_2-\overset{\overset{CH_2CH_3}{|}}{N}-(CH_2CH_2O)_{2-30}-H$$

(Fluorad ® FC-170 [3M Company])

Imaging Layers

The silver halide emulsion employed in the elements of this invention can be either negative working or positive working. Examples of suitable emulsions and their preparation are described in Research Disclosure, Sections I and II and the publication cited therein. Examples of suitable vehicles for the emulsion layers and other layers of elements of this invention are described in Research Disclosure, Section IX and the publications cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. The composition of said silver halide is preferably 70 mole percent or greater silver chloride, and most preferably 95 mole percent or greater silver chloride. Increasing the proportion of chloride increases the developability of said silver halide emulsions.

The silver halide emulsions employed in the elements according to the invention can be either negative-working or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520. Suitable vehicles for the emulsion layers and other layers of elements according to the invention are described in Research Disclosure Section IX and the publications cited therein. The radiation-sensitive materials described above can be sensitized to a particular wavelength range of radiation, such as the red, blue, or green portions of the visible spectrum or to other wavelength ranges, such as ultraviolet infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements of this invention or individual layers thereof can contain, for example, brighteners (see Research Disclosure, Section V), antifoggants and stabilizers (see Research Disclosure, Section VI), antistain agents and image dye stabilizers (see Research DisClosure, Section VII, paragraphs I and J), light absorbing and scattering materials (see Research Disclosure, Section VIII), hardeners (see Research Disclosure, Section IX), plasticizers and lubricants (see Research Disclosure, Section XII) antistatic agents (see Research Disclosure, Section XIII), matting agents (see Research Disclosure, Section XVI), and development modifiers (see Research Disclosure, Section XXI), reducing agents, and electron transfer agents. It is preferred that the elements of the present invention are devoid of reducing agents and electron transfer agents, so as to provide stability during preprocessing storage against chemical fogging.

Dye-Releasing and Dye-Forming Couplers and Compounds

Heat transferable dye-releasing and dye-forming couplers and compounds of any type may be utilized, so long as said dyes are diffusible at elevated temperature in a hydrophilic colloid such as gelatin and other hydrophilic colloids when said colloids are nominally dry (contain less than 50% by weight water). This dye diffusion and diffusibility may be aided with thermal solvents such as those of the present invention. While compounds releasing or forming dyes of any hue are suitable, couplers and compounds that form or release heat transferable dyes of cyan, magenta, and yellow hue are preferred. Typical couplers and compounds suitable for the present invention are described by Willis and Texter in U.S. application Ser. No. 07/804,877, filed Dec. 6, 1991, by Bailey et al. in U.S. application Ser. No. 07/804,868, filed Dec. 6, 1991, by Texter et al. in U.S. application Ser. No. 07/927,691, filed Aug. 10, 1992, by Texter et al. in U.S. application Ser. No. 07/993,580, filed Dec. 21, 1992, by Komamura in unexamined Japanese Kokai Hei 4[1992]-73751, and in U.S. Pat. Nos. 4,631,251, 4,650,748, and 4,656,124, the disclosures of which are incorporated herein by reference.

Incorporated couplers of the present invention comprise couplers that react with the oxidized product of a primary amine developing agent. Particularly preferred are compounds of the structure Cp-L-B, wherein Cp is a coupler moiety attached at the coupling position to a divalent linking group L, and where L is attached to a ballast group B. B may be any ballast group that decreases the heat transferability of the Cp-L-B compound. Suitable examples are given as structures B-1–B-19 by Willis and Texter in U.S. application Ser. No. 07/804,877, filed Dec. 6, 1991, and incorporated herein by reference. B most preferably is a polymeric backbone structure, and thereby imparts significant non-diffusibility to the Cp-L-B compound as a whole.

Thermal Solvents

Thermal solvents may be added to any layer(s) of the photographic element, including interlayers, imaging layers, and receiving layer(s), in order to facilitate transfer of dye to said receiving layer(s). Any organic compound that facilitates dye diffusion through hydrophilic binders such as gelatin, polyvinylalcohol, and polyvinylpyrrolidone is suitable as a thermal solvent in the elements and processes of the present invention so long as its melting point is between 50° C. and about 200° C., and so long as it can be dispersed as a solid particle dispersion. This lower limit of 50° C. is selected because it insures that the state during storage of the solid particle dispersion and during the preparation of coating melts incorporating said dispersions and thermal solvents, during the coating of said melts, and during the aqueous development of elements incorporating said dispersions. Such coating melt preparation, coating, and aqueous development is typically done at temperatures in the range of 20°–45° C., and solid particle thermal solvent dispersions of thermal solvents melting at 50° C. or greater are therefore expected to interact minimally with sensitized silver halide and the development chemistry, to thereby yield less variability in image formation. The upper limit of about 200° C. is selected because this is about the upper limit of temperature that can be applied at equilibrium to the more thermally robust supports available. The thermal solvent must be in a liquid or non-solid state during the heated dye-transfer step of the processes of the present invention. It is preferred that such thermal solvents be immiscible with water so that they do not wash out of photographic elements during aqueous development of said elements and in said processes. Suitable thermal solvents include 3-hydroxy benzoates, 4-hydroxy benzoates, 3-hydroxy benzamides, 4-hydroxy benzamides, 3-hydroxyphenyl acetamides, and 4-hydroxyphenyl acetamides that have melting points between 50° C. and about 200° C. Thermal solvents suitable for the dispersions, elements, and processes of the present invention have been disclosed by Bailey et al. in commonly assigned U.S. application Ser. No. 07/804,868, filed Dec. 6, 1991 and incorporated herein by reference. Other suitable thermal solvents that have melting points between 50° C. and about 200° C. include amides, hydrophobic ureas, benzamides, and alkyl and aryl sulfonamides as disclosed in formulae I–IV of unexamined Japanese Kokai Sho 62[1987]-136645 of Iwagaki et al., the disclosure of which is incorporated herein by reference.

Preferred thermal solvents have the structure:

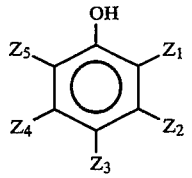

wherein (a) $Z_1$, $Z_2$, $Z_3$, $Z_4$, and $Z_5$ are substituents, the Hammet sigma parameters of $Z_2$, $Z_3$, and $Z_4$ sum to give a total, $\Sigma$, of at least $-0.28$ and less than 1.53;

(b) the calculated logP for I is greater than 3 and less than 10; and have melting points between 50° C. and about 200° C.

Suitable examples of said thermal solvents include aryl and alkyl esters of 3-hydroxy benzoic acid and of 4-hydroxy benzoic acid, 3-hydroxy benzamides, and 4-hydroxy benzamides.

Particularly preferred among such thermal solvents are 3-hydroxy benzoates and 4-hydroxy benzoates.

Since the activity of said thermal solvents is dependent on their being able to interact strongly with the binder and diffusing dyes in photographic elements of the present invention, during the heated transfer of dye-diffusion, it is preferred that said solvents have melting points below 200° C. It is particularly preferred that said thermal solvents have melting points below 160° C., so that the photographic elements of the present invention do not have to be heated excessively during heat transfer of dye. It is most preferred that said thermal solvents have melting points below 130° C., so that the photographic elements of the present invention can be coated on paper base supports and heated without concern for the blistering of said support during heat transfer of dye.

In a given layer, through which dye diffusion transfer is desired, thermal solvent is typically added at up to 300% by weight of binder in said layer. Preferably, said thermal solvent is added at 50 to 120% by weight of binder in said layer. The total thermal solvent incorporated as a solid particle dispersion in an element typically is 5 to 200% by weight of the total binder and is preferably 50 to 120% by weight of the total hydrophilic binder coated therein.

The invention colloidal dispersions of thermal solvents can be obtained by many methods for imparting mechanical shear well known in the art, such as those methods described in U.S. Pat. Nos. 2,581,414 and 2,855,156 and in Canadian Patent No. 1,105,761, the disclosures of which are incorporated herein by reference. These methods include solid-particle milling methods such as ball-milling, pebble-milling, roller-milling, sand-milling, bead-milling, dyno-milling, Masap-milling, and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Ball-milling, roller-milling, media-milling, and milling in an attriter are preferred milling methods because of their ease of operation, clean-up, and reproducibility. Microcrystalline thermal solvents are preferred in the preparation of solid particle thermal solvent dispersions when these preferred milling methods are used.

Alternatively, solid particle dispersions of thermal solvents, wherein said thermal solvent is present in an amorphous physical state, may be prepared by known methods including colloid milling, homogenization, high speed stirring, and sonication methods. The amorphous physical state of said thermal solvent may be transformed into a microcrystalline physical state by methods including thermal annealing and chemical annealing. Thermal annealing methods include temperature programmed thermal cycling to temperatures above any glass transition temperature of the amorphous coupler. Preferred thermal annealing comprises cycling said dispersion over the temperature range of 17° to 90 ° C. Said cycling may comprise any sequence of temperature changes that promotes microcrystalline phase formation from an extant amorphous physical state. Typically the duration of high temperature intervals are chosen to activate said phase formation while minimizing particle growth from ripening and collision processes. Chemical annealing methods include incubation with chemical agents that modify partitioning of thermal solvents and surfactants between the continuous phase of said dispersion and the discontinuous phase. Such agents include hydrocarbons (such as hexadecane), surfactants, alcohols (such as butanol, pentanol, and undecanol), and high boiling organic solvents. Said agents may be added to the dispersion during or subsequent to particle formation. Said chemical annealing may include incubating said dispersion at 17° to 90° C. in the presence of said agent, stirring said dispersion in the presence of said agent, adding said agent and then removing it slowly by diafiltration methods.

The formation of colloidal dispersions in aqueous media usually requires the presence of dispersing aids such as surfactants, surface active polymers, and hydrophilic polymers. Such dispersing aids have been disclosed by Chari et al. in U.S. Pat. No. 5,008,179 (columns 13–14) and by Bagchi and Sargeant in U.S. Pat. No. 5,104,776 (see columns 7–13) and are incorporated herein by reference. Preferred dispersing aids include sodium dodecyl sulfate (DA-1), sodium dodecyl benzene sulfonate (DA-2), sodium bis(2-ethyl hexyl)sulfosuccinate (DA-3), Aerosol-22 (Cyanamid), sodium bis(1-methyl pentyl)sulfosuccinate (DA-4), sodium bis(-phenylethyl)sulfosuccinate (DA-5), sodium bis(β-phenyl ethyl)sulfosuccinate (DA-6), sodium bis(2-phenyl propyl)sulfosuccinate (DA-7), and the following:

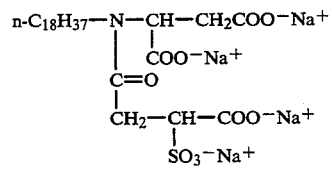

(DA-8)

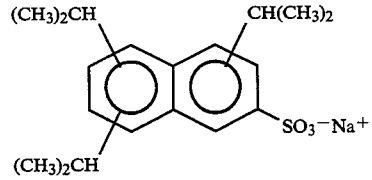

(DA-9)

-continued (DA-10)

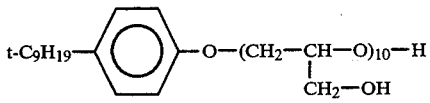

(DA-11)

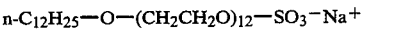

(DA-12)

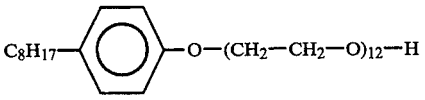

(DA-13)

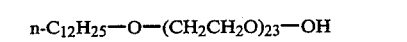

(DA-14)

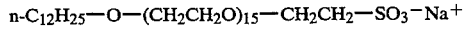

(DA-15)

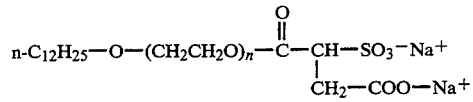

(DA-16)

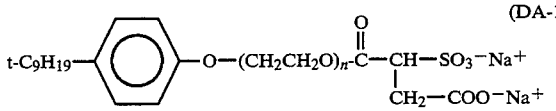

(DA-17)

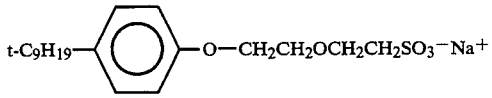

Preferred hydrophilic polymers include gelatin, polyvinylalcohol, and polyvinylpyrollidone. Such dispersing aids are typically added at level of 1%–200% of dispersed coupler (by weight), and are typically added at preferred levels of 3%–30% of dispersed coupler (by weight). Hydrophilic polymers may be added to the thermal solvent dispersions of the present invention before, during, and after milling to effect particle size reduction.

Colloidal solid particle of thermal solvent less than 1 μm in largest dimension are preferably obtained because of their propensity to scatter less light than larger particles. More preferably because of even less scattering of light, colloidal thermal solvent particles less than 0.2 μm in largest dimension are obtained.

Exposure and Development

Photographic elements can be exposed to actinic radiation, typically in the visible region of the spectrum, to form a latent image as described in Research Disclosure, Section XVIII and then processed to form a visible dye image as described in Research Disclosure, Section XIX. Processing to form a visible dye image includes the step of contacting the element with a color developing agent to reduce developable silver halide and oxidizing the color developing agent. Oxidized color developing agent in turn reacts with the coupler to release a diffusible dye. Said contacting of the element with a color developing agent comprises wetting at least the emulsion side of said element with a volume of processing solution that exceeds the swelling volume of the element.

A negative image can be developed. A positive image can be developed by first developing with a nonchromogenic developer, then uniformly fogging the element, and then developing by a process employing one or more of the aforementioned nucleophiles.

With negative working silver halide, the processing step described above gives a negative image. To obtain a positive (or reversal) image, this step can be preceded by development With a nonchromogenic developing agent to develop exposed silver halide, but not form dye, and then uniformly fogging the element to render unexposed silver halide developable. Alternatively, a direct positive emulsion can be employed to obtain a positive image.

Aqueous development utilizing primary amine reducing agents such as p-phenylenediamines and p-aminophenols is typically used. Preferred color developing agents which are useful with the nondiffusing dye-releasing and dye-forming couplers and compounds of this invention include the following:

4-amino-N-ethyl-3-methyl-N-β-sulfoethyl)aniline
4-amino-N-ethyl-3-methoxy-N-(β-sulfoethyl)aniline
4-amino-N-ethyl-N-(β-hydroxyethyl)aniline
4-amino-N,N-diethyl-3-hydroxymethyl aniline
4-amino-N-methyl-N-(β-carboxyethyl)aniline
4-amino-N,N-bis-(β-hydroxyethyl)aniline
4-amino-N,N-bis-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4- amino-N,N-diethyl-3-(3-hydroxypropoxy)aniline These developing agents produce dyes that have advantageous diffusibility. After image formation the element is subjected to a stop and wash bath that may be the same or different. Thereafter, the element is dried. Said stop, wash, or drying steps may be omitted. Bleaching and fixing steps are absent in the diffusion transfer processes of the present invention. The need for these steps is obviated by the dye diffusion transfer process inherent in heat image separation systems. The polution effluent that normally results from bleaching and fixing processing steps is advantageously eliminated in the processes of the present invention.

Diffusion Dye Transfer

Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C. Particularly useful methods of heating and stripping are described by Texter et al. in U.S. Pat. No. 5,164,280 and by Lynch and Texter in U.S. application Ser. No. 07/858,726, the disclosures of which are incorporated herein in their entireties.

The advantages of the present invention will become more apparent by reading the following examples. The scope of the present invention is by no means limited by these examples, however.

EXAMPLES 1–8

These examples illustrate how the dispersions of the present invention solve a previously unrecognized problem in silver halide emulsion desensitization. It is shown that thermal solvent dispersions can cause dramatic desensitization of spectrally sensitized silver halide emulsion. It is also demonstrated that thermal solvent dispersions of the present invention, namely solid particle thermal solvent dispersions of thermal solvents having melting points above 50° C., can be mixed with such sensitized silver halide emulsions without causing dramatic desensitization, when said mixing is done at temperatures below the melting point of thermal solvent in said solid particle thermal solvent dispersions.

Dispersion Preparation

Magenta dye-forming coupler M-1 was dispersed by well known colloid milling methods. Ethyl acetate (36 g) and M-1 (12 g) were combined and heated to dissolution. An aqueous gelatin solution was prepared by combining 4.8 g of 10% (w/w) aqueous DA-9, about 43.3 g of 8.3% aqueous gelatin, and about 24 g of water. These ethyl acetate and gelatin solutions were combined and stirred, and the resulting dispersion was passed through a colloid mill 5 times, chill set, noodled, washed to remove ethyl acetate, melted, chill set, and stored in the cold until used for melt preparation.

M-1

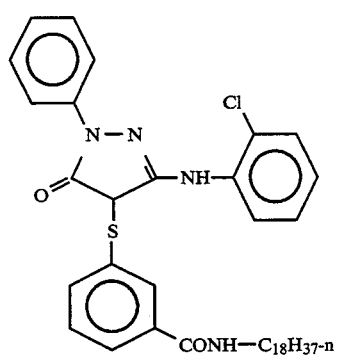

A comparison thermal solvent dispersion of 4-hydroxy-(2'-ethylhexyl) benzoate (TS-1), a liquid at room temperature, was prepared by similar means. TS-1 was obtained from Pfaltz and Bauer. An aqueous solution of 10% (w/w) aqueous DA-9 (6 g), 8.3% aqueous gelatin (about 54 g), and water (74.9 g) was combined with 15 g TS-1, stirred, passed through a colloid mill 5 times, chill set, and stored in the cold until used for melt preparation. This colloid milled dispersion was designated a TS-1 CM dispersion. A solid particle thermal solvent dispersion of 4-hydroxy-nonyl benzoate (TS-2; Pfaltz and Bauer; melting point 90°–93° C.) was prepared similarly. About 12 g of TS-2 was dissolved in 24 g of ethyl acetate. An aqueous gelatin solution comprising 4.8 g of 10% (w/w) aqueous DA-9, 43.3 g of 8.3% (w/w) aqueous gelatin, and 35.9 g of water was prepared and mixed with the TS-2/ethyl acetate solution to give a crude dispersion. This dispersion was passed through a colloid mill 5 times, chill set, noodled, washed to remove ethyl acetate, remelted, chill set, and stored in the cold until used for melt preparation. This colloid milled dispersion was designated TS-2 (CM). Another solid particle thermal solvent dispersion of TS-2 was prepared by roller milling methods. About 18 g of TS-2 was combined with 36 g of 10% aqueous DA-9, 66 g of water, and about 100 mL of 1.8–2.1 mm-diameter zirconia milling media and placed in a sealed glass jar. This jar was placed on a roller mill for about 123 hours, and a fine particle sized aqueous dispersion was obtained. This dispersion was passed through a cloth filter. About 110 g of this filtrate was combined with about 55.3 g of 8.3% (w/w) aqueous gelatin and 1.9 g of water at about 40° C., stirred, chill set, and stored in the cold until used for melt preparation. This roller milled dispersion was designated TS-2 RM.

A cubic AgCl emulsion of 0.30 μm edge length was spectrally sensitized with the tetrabutyl ammonium salt of sensitizing dye SD-1. About 300 mg SD-1 per mole AgCl was added to the primitive cubic AgCl emulsion. The emulsion was then chemically sensitized with a gold sensitizing agent as described in U.S. Pat. No. 2,642,316. Thereafter, the emulsion was digested at 70° C.

SD-1

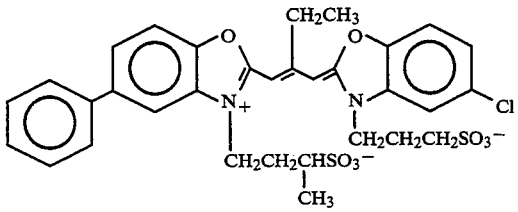

Coating and Evaluation

The test coating structure comprising several layers is illustrated in Table 1. The dye-receiving layer comprised polycarbonate and polycaprolactam and was coated on titania pigmented reflection paper base. This titania pigmented paper base was resin coated with high density polyethylene, and coated with a mixture of polycarbonate, polycapro-lactone, and 1,4-didecyloxy-2,5-dimethoxy benzene at a 0.77:0.115:0.115 weight ratio respectively, at a total coverage of 3.28 g/m$^2$. This polymeric dye-receiving layer was subjected to a corona discharge bombardment within 24 h prior to coating the test elements.

Four experimental coatings were prepared. Coating 1 served as a reference check coating and contained no thermal solvent. Coating 2 was prepared with the TS-1 CM dispersion, and serves to illustrate the previously unrecognized problem of desensitization during melt hold by thermal solvent interactions with sensitized silver halide. Coatings 3 and 4 are invention coatings prepared with the CM and RM solid particle TS-2 dispersions.

TABLE 1

| |
|---|
| Protective Overcoat Layer |
| gelatin (1.07 g/m$^2$) |
| Imaging Layer |
| Green Sensitited AgCl (394 mg Ag/m$^2$) |
| Coupler M-1 (729 mg/m$^2$) |
| Thermal Solvent (0–1.07 g/m$^2$) |
| gelatin (1.07 g/m$^2$) |
| Dye-Receiving Layer |
| Titania Pigmented Paper Base |

Premelts comprising coupler M-1, most of the gelatin, spreading surfactants, and thermal solvent (if any) were prepared. The above described AgCl emulsion was then added to each of these premelts and held at 40°–45° C. with stirring for 20 minutes before coating. After coating these melts on the support/receiving layer base, an overcoat was applied. This overcoat contained hardener (1,1'-[methylenebis{sulfonyl}]bisethene) at a level corresponding to about 1.5% (w/w) of the total gelatin coated (2.14 g/m$^2$). After coating and chopping, the sensitized strips were exposed on a sensitometer to a tungsten light source through a Wratten 99 filter and a 0 to 3 density 21-step tablet and processed at 35° C. in two different process sequences. Both processing sequences at 35° C. started with 45" development in a developer of the following composition:

| | |
|---|---|
| Triethanolamine | 12.41 g |
| Phorwite REU (Mobay) | 2.3 g |
| Lithium polystyrene solfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH 10.04 ± 0.05 at 27° C. | |

In processing sequence 1, Examples 1–4, development was followed by 45" treatment in a bleach-fix solution, 90" of washing in water, and convective drying. In sequence 2, Examples 5–8, development was followed by 60" treatment in a sulfuric acid stop bath (pH 0.9@27° C.), 60" in a pH 7 buffer, 90" of rinsing in water, and convective drying.

After drying, the coatings of Examples 1–4 were read by status A reflection densitometry for magenta density, and the relative speeds determined in log-exposure (log E) units at densities of 0.1 above Dmin. The relative speeds for Examples 2, 3, and 4 were determined relative to the speed point of Example 1, and are listed in Table 2. The greater than 3 stop desensitization resulting from interactions between the spectrally sensitized emulsion and the TS-1 CM dispersion is evident in the −1.11 logE speed shift observed in Example 2. The solid particle dispersions of TS-2, on the other hand, did not result in any speed loss whatsoever. In fact, slight speed increases of +0.03 and +0.07 logE were observed for coatings of the solid particle dispersions of Examples 3 and 4, respectively.

The coatings of Examples 5–8 were heat treated to effect dye diffusion transfer after drying. These dried coatings were laminated with a gel-subbed adhesion sheet of

TABLE 2

| Example | Coating | Thermal Solvent Dispersion | ΔlogE[a] |
|---|---|---|---|
| 1 | 1 | none | — |
| 2 | 2 | TS-1(CM) | −1.11[b] |
| 3 | 3 | Comparison TS-2(CM) | +0.03[b] |
| 4 | 4 | Invention TS-2(RM) | +0.07[b] |

TABLE 2-continued

| Example | Coating | Thermal Solvent Dispersion | ΔlogE[a] |
|---|---|---|---|
| 5 | 1 | Invention none | — |
| 6 | 2 | TS-1(CM) | −1.07[c] |
| 7 | 3 | Comparison TS-2(CM) | +0.21[c] |
| 8 | 4 | Invention TS-2(RM) | +0.30[c] |

[a]At speed point, 0.1 density units above Dmin.
[b]Relative to speed point of Example 1.
[c]Relative to speed point of Example 5.

ESTAR as described in U.S. Pat. No. 5,164,280, and passed three times through pinch rollers having surface temperatures of about 110° C. and at 20 psi and about 0.63 cm per second. After the third pass, the adhesion sheet was stripped away, thereby removing the hardened overcoat and imaging layers from the support/receiving layer element. The developed silver and undeveloped silver chloride, contained in the imaging layer, were thereby separated from the dye diffusion image in the receiver layer. The images in the receiver layer of these coatings of Examples 5–8 were then read by status A reflection densitometry for magenta density, and the relative speeds determined in log-exposure (log E) units at densities of 0.1 above Dmin relative to the speed point of Example 5 were determined. These relative speeds are listed in Table 2. Similar results as for Examples 1–4 were obtained. The TS-1 CM dispersion in Example 6 yielded a −1.07 logE speed shift, while the solid particle dispersions of TS-2, yielded speed increases of +0.21 and +0.30 logE in Examples 7 and 8, respectively. These results show that solid particle dispersions of thermal solvents, where said thermal solvents have melting points significantly higher than melt hold and coating temperatures, have less interaction with sensitized silver halide than do dispersions of low-melting thermal solvents.

EXAMPLES 9–13

These examples illustrate how the dispersions of the present invention solve a previously unrecognized problem in cyan dye forming coupling activity. It is shown that thermal solvent dispersions can cause dramatic inhibition of cyan coupling activity. It is also demonstrated that thermal solvent dispersions of the present invention, namely solid particle thermal solvent dispersions of thermal solvents having melting points above 50° C., can be mixed with and coated with cyan coupler dispersions and obtain significantly greater coupling activity than obtained with comparison thermal solvent dispersions of thermal solvents that have melting points below 50° C. The processing in these examples includes bleaching and fixing steps in order to examine the phenomenon of coupling reactivity, as exemplified by dye density yields (DDY). DDY is defined as the slope of a graph of dye density versus developed silver. Fixing is done in these examples to remove undeveloped silver halide, so that the only silver remaining is due to developed silver. Bleaching and fixing of some of the strips in these examples was done to facilitate the measurement of reflectance optical densities of formed cyan dye, without having to carry out thermal dye diffusion transfer steps of the processes of the present invention. An analysis of the relative reactivities of the cyan dispersion coupling in these examples, and the impact on these reactivities by interactions with thermal solvents, must be done prior to dye diffusion transfer, in order to conform with accepted theory of coupling reactivity, as detailed by Texter in *J. Photographic Science*, volume 36, pages 14–17 (1988), the disclosure of which is incorporated herein by reference.

Dispersion Preparation

Cyan dye-forming coupler C-1 was dispersed by well known colloid milling methods in aqueous gelatin using DA-9 as a dispersing aid and di-n-butyl phthalate as a coupler solvent. Coupler C-1 and di-n-butyl phthalate were combined at a weight

C-1

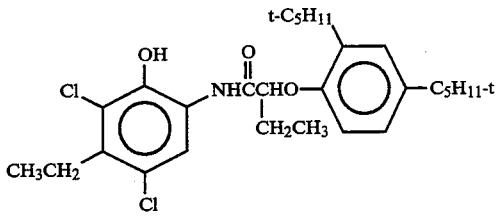

ratio of about 1:0.5. A dispersion of an oxidized developer scavenger, S-1, was also prepared by similar means. Dispersions of TS-1 and TS-2 (CM) were prepared by colloid milling techniques as described above in Examples 1–8. Two comparison

S-1

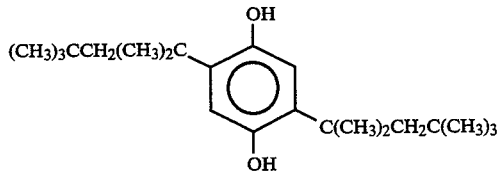

TS-3

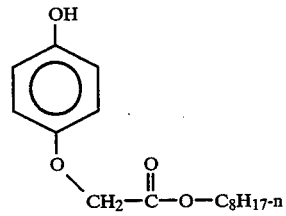

dispersions of TS-3, one by colloid milling (CM) and one by roller milling (RM) were prepared similarly as described above for the TS-2 dispersions in Coatings 3 and 4 for Examples 3, 4, 7, and 8. Thermal solvent TS-3 has a melting point in the range of 37°–39° C., and therefore falls outside the scope of the present invention.

Coating and Evaluation

The test coating structure for Coatings 5–9 (Examples 9–13, respectively) comprising several layers is illustrated in Table 3. The dye-receiving layer and titania pigmented paper base were as described earlier for Coatings 1–4. This polymeric dye-receiving layer was subjected to a corona discharge bombardment within 24 h prior to coating the test elements.

Five experimental coatings were prepared. Coating melts were prepared at about 40°–45° C. and these melts were maintained at about 40°–45° C. during the coating operation. Coating 5 served as a reference check coating and contained no thermal

TABLE 3

| Protective Overcoat Layer |
|---|
| gelatin (1.07 g/m$^2$) |
| Imaging Layer |
| Red Sensitited AgCl (198 mg Ag/m$^2$) |
| Coupler C-1 (420 mg/m$^2$) |
| Thermal Solvent (0–0.86 g/m$^2$) |
| S-1 (5 mg/m$^2$) |
| gelatin (1.07 g/m$^2$) |
| Dye-Receiving Layer |
| Titania Pigmented Paper Base |

solvent. Coating 6 was prepared with the TS-1 CM dispersion, and serves to illustrate the previously unrecognized problem of severe inhibition of cyan coupling activity during melt hold, coating, storage, and processing by thermal solvent interactions with the cyan coupler dispersion of C-1. Coating 7 is an invention coating prepared with the CM solid particle TS-2 dispersion. Coatings 8 and 9 are comparison coatings that also serve to illustrate the previously unrecognized problem of severe inhibition of cyan coupling activity during melt hold, coating, storage, and processing by thermal solvent interactions with the cyan coupler dispersion of C-1. Coating 8 contains the TS-3 CM dispersion and Coating 9 contains the TS-3 RM dispersion. Coatings 8 and 9 are comparison coatings because TS-3 melts over the range of 37°–39° C. and is not a thermal solvent of the dispersions, elements, or processes of the present invention; although TS-3 is a solid at room temperature, it is a liquid at normal coating melt hold and coating temperatures of about 40° C. All of these coatings were coated with an overcoat gelatin layer containing hardener. This overcoat contained hardener (1,1'-[methylenebis{sulfonyl}]bis-ethene) at a level corresponding to about 1.5% (w/w) of the total gelatin coated (2.14 g/m$^2$).

After coating and chopping, strips of these coatings were exposed on a sensitometer to a tungsten light source through a 0 to 3 density 21-step tablet. Each of these exposed strips was slit into two parallel strips and processed at about 20° C. for 180" development in the developer solution described above and used in Examples 1–8. One of these slit strips was processed in a bleach-fix solution to remove all silver chloride and developed silver to leave only a dye image and the other of each of these slit strips was processed in a fix solution to remove undeveloped silver chloride, but to allow the developed silver to remain. These fixed, but not bleached, strips were read step-wise for developed silver by x-ray fluorescence. The blixed strips were read step-wise by status A reflection densitometry for cyan dye density. Graphs of cyan status A density (OD) versus developed silver (mg Ag/m$^2$) were prepared for each of these coatings, and the initial dye density yield, defined as the slope of these graphs at developed silver levels below 1.11 mg Ag/m$^2$ was determined by linear regression. Correlation coefficients were greater than 0.95 in all of these fits. The corresponding initial dye density yields (DDY) are listed in Table 4 for each of these Coatings 5–9. Dye density yields, under the same processing conditions, are good comparative measures of coupling reactivity, as is detailed by Texter in *J. Photographic Science*, volume 36, pages 14–17 (1988). It is seen that the control coating, Coating 5 (Example 9), had a DDY of 0.015 OD/mg Ag/m$^2$. Example 10 (Coating 6 of the comparison TS-1 CM dispersion) gave a DDY of 0.003 OD/mg Ag/m$^2$, and shows that the presence of TS-1, a liquid at room temperature, during coating melt preparation, coating, and development causes the DDY to fall to about 20% of that

TABLE 4

| Example | Coating | Thermal Solvent Dispersion | DDY[a] (OD/mg Ag/m²)[b] |
|---|---|---|---|
| 9 | 5 | none Control | 0.015 |
| 10 | 6 | TS-1(CM) Comparison | 0.003 |
| 11 | 7 | TS-2(CM) Invention | 0.012 |
| 12 | 8 | TS-3(CM) Comparison | 0.004 |
| 13 | 9 | TS-3(RM) Comparison | 0.003 |

[a]Initial dye density yield.
[b]Optical density (status A, cyan) per mg developed silver per square meter.

obtained in the control coating. Example 11, a coating of an invention dispersion of TS-2, exhibits a DDY of 0.012 OD/mg Ag/m², nearly as large as the control (Example 9). Examples 12 and 13, CM and RM coatings of TS-3, respectively, also exhibit this severe coupling activity inhibition with DDY of 0.004 and 0.003 OD/mg Ag/m², respectively. TS-3 is a solid at room temperature, but melts over the 37°–39° C. range, and is therefore liquid during the 40°–45° C. melting and coating operations of the present coating preparations.

The invention has been described in detail with particular reference to preferred embodiments thereof, but it will be understood that variations and modifications can be effected within the spirit and scope of the invention.

What is claimed is:

1. An aqueous developable chromogenic photographic dye-diffusion transfer element of two or more layers comprising a support, radiation sensitive silver halide, a dye-forming compound wherein said compound forms a heat transferable dye upon reaction of said compound with the oxidation product of a primary amine developing agent and wherein said heat transferable dye does not contain water solubilizing groups to immobilize said heat transferable dye in dry gelatin, a hydrophilic binder, and a solid particle thermal solvent dispersion, wherein said thermal solvent is a water-immiscible phenol derivative, has a melting point of between 50° C. and about 130° C., and is incorporated at 5 to 200% by weight of said hydrophilic binder, and where said thermal solvent dispersion contains a dispersing aid at a thermal solvent to dispersing aid weight ratio of 1:0.01 to 1:2.

2. An element as in claim 1, wherein the mean size of particles in said solid particle thermal solvent dispersion is less than 1 μm in largest dimension.

3. An element as in claim 1, wherein the mean size of particles in said solid particle thermal solvent dispersion is less than 0.2 μm in largest dimension.

4. An element as in claim 1, wherein said hydrophilic binder is selected from the group consisting of gelatin, polyvinylalcohol, or polyvinylpyrollidone.

5. An element as in claim 1, wherein said dispersing aid comprises at least one of sodium dodecyl sulfate, sodium dodecyl benzene sulfonate, sodium bis(2-ethylhexyl)sulfosuccinate), sodium bis(1-methyl pentyl)sulfosuccinate, sodium bis(phenylethyl)sulfosuccinate, sodium bis(β-phenyl ethyl)sulfosuccinate, sodium bis(2-phenyl propyl)sulfosuccinate, and the following:

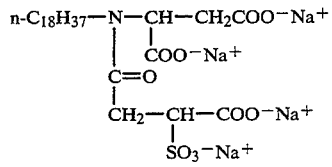

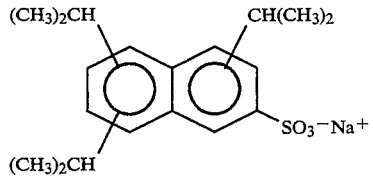

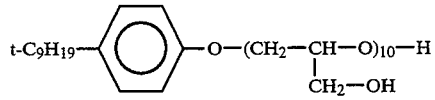

$n\text{-}C_{12}H_{25}—O—(CH_2CH_2O)_{12}—SO_3^-Na^+$

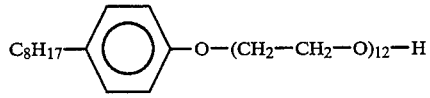

$n\text{-}C_{12}H_{25}—O—(CH_2CH_2O)_{23}—OH$ $n\text{-}C_{12}H_{25}—O—(CH_2CH_2O)_{15}—CH_2CH_2—SO_3^-Na^+$

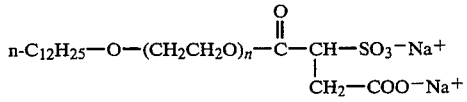

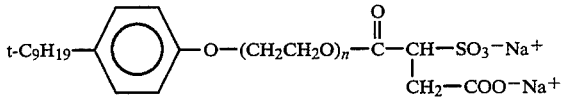

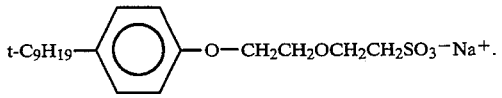

6. An element as in claim 1, wherein said dispersing aid is present in said thermal solvent dispersion at a thermal solvent to dispersing aid weight ratio of 1:0.03 to 1:0.3.

7. An element as in claim 1, wherein said thermal solvent has the structure:

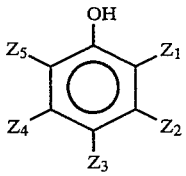

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10.

8. An element as in claim 7, wherein said thermal solvent comprises at least one 3-hydroxy benzoate or 4-hydroxy benzoate.

9. An element as in claim 1, wherein said thermal solvent is incorporated at a level of 50 to 120% by weight of the total hydrophilic binder.

10. An element as in claim 1, wherein said element in addition contains a dye-receiving layer intermediate said support and any layer containing silver halide or dye-forming compound.

11. An element as in claim 10, wherein said dye-receiving layer comprises at least one poly-carbonate, polyurethane, polyester, polyvinyl chloride, poly(styrene-co-acrylonitrile), or poly(caprolactone).

12. An element as in claim 10, wherein said diffusion transfer element comprises a stripping layer intermediate said dye-receiving layer and said silver halide containing and said dye-forming compound containing layers.

13. An element as in claim 1, wherein said silver halide comprises greater than 95 mole percent silver chloride.

14. An element as in claim 1, wherein said diffusion transfer element is devoid of any developing agent or electron transfer agent.

15. An element as in claim 1, wherein said developer agent is selected from the group consisting of 4-amino-N,N-diethylaniline; 4-amino-3-methyl-N,N-diethyl aniline; 4-amino-3-methyl-N-ethyl-N-(β-methanesulfonamidoethyl)aniline; 4-amino-3-methyl-N-ethyl-N-(β-hydroxyethyl)aniline; 4-amino-3-(β-methanesulfonamidoethyl)aniline; and 4-amino-3-methyl-N-ethyl-N-(2-methoxyethyl)aniline.

16. An aqueous developable chromogenic photographic dye-diffusion transfer element of two or more layers comprising a support, radiation sensitive silver halide, a dye-forming compound wherein said compound forms a heat transferable dye upon reaction of said compound with the oxidation product of a primary amine developing agent, a hydrophilic binder, and a solid particle thermal solvent dispersion, wherein said thermal solvent is a water-immiscible phenol derivative, has a melting point of between 50° C. and about 130° C., and is incorporated at 5 to 200% by weight of said hydrophilic binder, and where said thermal solvent dispersion contains a dispersing aid, and wherein said diffusion transfer element further comprises a dye-receiving layer intermediate said support and any layer containing silver halide or dye-forming compound, and wherein said diffusion transfer element is devoid of any developing agent or electron transfer agent.

17. An element as in claim 16, wherein the mean size of particles in said solid particle thermal solvent dispersion is less than 0.2 μm in largest dimension.

18. An element as in claim 16, wherein said hydrophilic binder is selected from the group consisting of gelatin, polyvinylalcohol, or polyvinylpyrollidone.

19. An element as in claim 16, wherein said dispersing aid comprises at least one of sodium dodecyl sulfate, sodium dodecyl benzene sulfonate, sodium bis(2-ethylhexyl)sulfosuccinate), sodium bis(1-methyl pentyl)sulfosuccinate, sodium bis(phenylethyl)sulfosuccinate, sodium bis(β-phenyl ethyl)sulfosuccinate, sodium bis(2-phenyl propyl)sulfosuccinate, and the following:

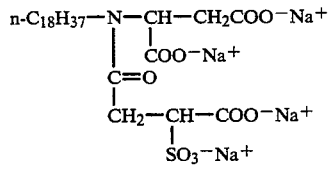

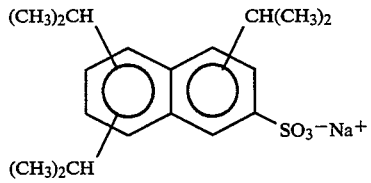

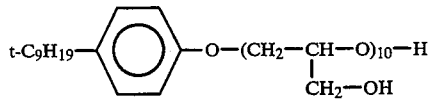

$n\text{-}C_{12}H_{25}—O—(CH_2CH_2O)_{12}—SO_3^-Na^+$

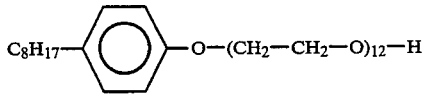

$n\text{-}C_{12}H_{25}—O—(CH_2CH_2O)_{23}—OH$ $n\text{-}C_{12}H_{25}—O—(CH_2CH_2O)_{15}—CH_2CH_2—SO_3^-Na^+$

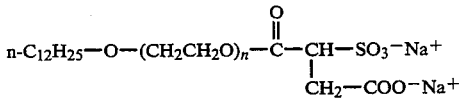

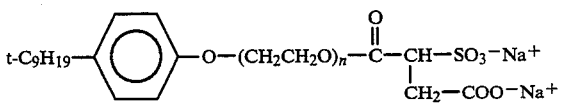

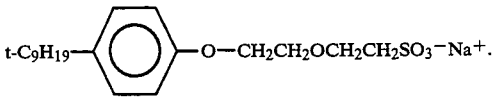

20. An element as in claim 16, wherein said dispersing aid is present in said thermal solvent dispersion at a thermal solvent to dispersing aid weight ratio of 1:0.01 to 1:2.

21. An element as in claim 16, wherein said dispersing aid is present in said thermal solvent dispersion at a thermal solvent to dispersing aid weight ratio of 1:0.03 to 1:0.3.

22. An element as in claim 16, wherein said thermal solvent has the structure:

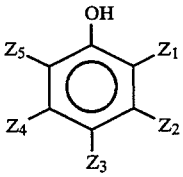

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10.

23. An element as in claim 16, wherein said thermal solvent comprises at least one 3-hydroxy benzoate or 4-hydroxy benzoate.

24. An element as in claim 16, wherein said thermal solvent is incorporated at a level of 50 to 120% by weight of the total hydrophilic binder.

25. An element as in claim 16, wherein said dye-receiving layer comprises at least one poly-carbonate, polyurethane, polyester, polyvinyl chloride, poly(styrene-co-acrylonitrile), or poly(caprolactone).

26. An element as in claim 16, wherein said diffusion transfer element comprises a stripping layer intermediate said dye-receiving layer and said silver halide containing and said dye-forming compound containing layers.

27. An element as in claim 16, wherein said silver halide comprises greater than 95 mole percent silver chloride.

28. An aqueous developable chromogenic photographic dye-diffusion transfer element of two or more layers comprising a support, radiation sensitive silver halide, a dye-forming compound wherein said compound forms a heat transferable dye upon reaction of said compound with the oxidation product of a primary amine developing agent, a hydrophilic binder, and a solid particle thermal solvent dispersion, wherein said thermal solvent is a water-immiscible phenol derivative, has a melting point of between 50° C. and about 130° C., and is incorporated at 5 to 200% by weight of said hydrophilic binder, and where said thermal solvent dispersion contains a dispersing aid at a thermal solvent to dispersing aid weight ratio of 1:0.01 to 1:2, and further where said element is devoid of any developing agent or electron transfer agent.

29. An element as in claim 28, wherein the mean size of particles in said solid particle thermal solvent dispersion is less than 1 μm in largest dimension.

30. An element as in claim 28, wherein the mean size of particles in said solid particle thermal solvent dispersion is less than 0.2 μm in largest dimension.

31. An element as in claim 28, wherein said hydrophilic binder is selected from the group consisting of gelatin, polyvinylalcohol, or polyvinylpyrollidone.

32. An element as in claim 28, wherein said dispersing aid comprises at least one of sodium dodecyl sulfate, sodium dodecyl benzene sulfonate, sodium bis(2-ethylhexyl)sulfosuccinate), sodium bis(1-methyl pentyl)sulfosuccinate, sodium bis(phenylethyl)sulfosuccinate, sodium bis(β-phenyl ethyl)sulfosuccinate, sodium bis(2-phenyl propyl)sulfosuccinate, and the following:

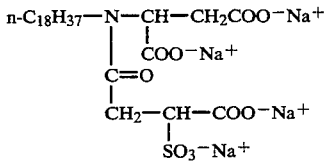

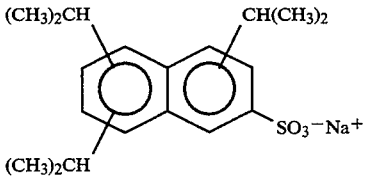

-continued

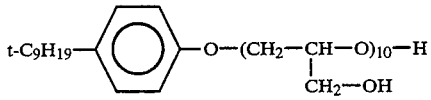

$n\text{-}C_{12}H_{25}—O—(CH_2CH_2O)_{12}—SO_3^-Na^+$

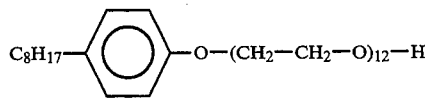

$n\text{-}C_{12}H_{25}—O—(CH_2CH_2O)_{23}—OH$ $n\text{-}C_{12}H_{25}—O—(CH_2CH_2O)_{15}—CH_2CH_2—SO_3^-Na^+$ $n\text{-}C_{12}H_{25}—O—(CH_2CH_2O)_n—C(=O)—CH(CH_2—COO^-Na^+)—SO_3^-Na^+$

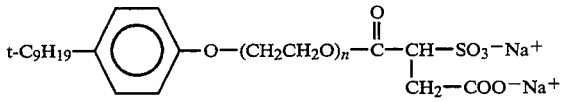

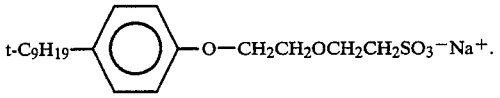

33. An element as in claim 26, wherein said dispersing aid is present in said thermal solvent dispersion at a thermal solvent to dispersing aid weight ratio of 1:0.03 to 1:0.3.

34. An element as in claim 26, wherein said thermal solvent has the structure:

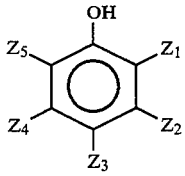

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for I is greater than 3 and less than 10.

35. An element as in claim 26, wherein said thermal solvent comprises at least one 3-hydroxy benzoate or 4-hydroxy benzoate.

36. An element as in claim 26, wherein said thermal solvent is incorporated at a level of 50 to 120% by weight of the total hydrophilic binder.

37. An element as in claim 28, wherein said element in addition contains a dye-receiving layer intermediate said support and any layer containing silver halide or dye-forming compound.

38. An element as in claim 37, wherein said dye-receiving layer comprises at least one poly-carbonate, polyurethane, polyester, polyvinyl chloride, poly(styrene-co-acrylonitrile), or poly(caprolactone).

39. An element as in claim 37, wherein said diffusion transfer element comprises a stripping layer intermediate said dye-receiving layer and said silver halide containing and said dye-forming compound containing layers.

40. An element as in claim 28, wherein said silver halide comprises greater than 95 mole percent silver chloride.

* * * * *